US007381003B1

(12) United States Patent
Chang

(10) Patent No.: US 7,381,003 B1
(45) Date of Patent: Jun. 3, 2008

(54) APPLICATOR OF COSMETIC CREAM JAR

(76) Inventor: Chia-Sheng Chang, 2No. 52, Feng Chang Street, Nan Tun District, Taichung City (TW)

( * ) Notice: Subject to any disclaimer, the term of this patent is extended or adjusted under 35 U.S.C. 154(b) by 0 days.

(21) Appl. No.: 11/626,385

(22) Filed: Jan. 24, 2007

(51) Int. Cl.
*A45D 33/00* (2006.01)
*A46B 11/00* (2006.01)

(52) U.S. Cl. ..... 401/130; 401/126; 401/16; 132/317

(58) Field of Classification Search ..... 401/121–127, 401/129, 130, 18, 16; 132/317
See application file for complete search history.

(56) References Cited

U.S. PATENT DOCUMENTS 3,951,157 A * 4/1976 Idec ..... 401/122
6,447,191 B1 * 9/2002 Vasas ..... 401/7
6,773,187 B2 * 8/2004 Gueret ..... 401/130
7,044,669 B2 * 5/2006 Winckels et al. ..... 401/122
7,226,227 B2 * 6/2007 Gueret ..... 401/18

* cited by examiner

*Primary Examiner*—David J Walczak
(74) *Attorney, Agent, or Firm*—Leong C. Lei

(57) ABSTRACT

A cosmetic jar includes a container containing cosmetic cream and having an opening in which a receptacle is received and retained and a cap releasably mounted to the opening of the container with threading engagement and carrying a bud made of a soft, elastically deformable and cream-absorbing material, the bud being receivable into the receptacle in a slightly compressed condition so that when the bud is removed out of the receptacle by a rotary operation of the cap with respect to the container, a uniform coating of the cream is absorbed by and formed on the bud. A cavity is defined in a top of the cap and is operably closed by a lid. The cavity serves as an additional storage space for cosmetics, which can be different from the cream contained in the container.

3 Claims, 5 Drawing Sheets

APPLICATOR OF COSMETIC CREAM JAR

BACKGROUND OF THE INVENTION a) Technical Field of the Invention

The present invention relates to a cosmetic jar containing flowable cosmetics, such as cream and ointment, and in particular to an applicator that is mounted to a cap portion and fit into a receptacle received and retained in a container portion for being compressed and absorbing the cream stored in the receptacle and where the cap portion forms a top cavity for receiving different cosmetics.

b) Description of the Prior Art

A conventional cosmetic jar, especially a jar for containing cosmetic cream or ointment, is often provided with a scraper plate to allow a user to pick up a desired amount of cream from the jar. As shown in FIGS. 7 and 8 of the attached drawings, the conventional cosmetic jar comprises a container 30 which forms a hollow space for receiving the cosmetic cream is received through an opening and a cap 31 releasably mounted to the container 30 for closing the opening. For efficient access of the cream, the cap 31 is provided with the scraper plate, which is designated with reference numeral 32 in the drawings. The scraper plate 32 is made slightly concaved to hold an amount of cream thereon. The scraper plate 32, although effective in picking up an amount of the cream from the container, is incapable to precisely control the amount of the cream picked up. For example, an excessive amount of cream picked up by the scraper plate may caused by the gravity to flow out of the scraper plate and form droplets. To solve such a problem, the user may need to level off the excessive amount of cream by sweeping the scraper plate through a rim of the opening of the container to force the excessive cream to flow back into the container. However, such an operation requires care be exercised to avoid undesired overflowing of the scream off the rim. This often causes undesired contamination and inconvenience.

Thus, it is desired to provide an application device for a cosmetics containing jar that overcomes the above discussed problems associated with the conventional cosmetic jars.

SUMMARY OF THE INVENTION

The primary purpose of the present invention is to completely solve the conventional disadvantages by providing an application device having a receptacle that is received and retained in a container that contains cosmetic cream, which is allowed to partially flow into the receptacle, and a bud that is excellent in absorbing the cosmetic cream and is positionable into the receptacle in a slightly compressed manner, whereby when the bud is removed out of the receptacle, it absorbs the cream while gradually expanding to allow formation of uniform coating of the cream thereon. No additional scraping or leveling operation is needed.

To achieve the objective, the present invention provides a cosmetic jar comprising a container containing cosmetic cream therein and having an opening in which a receptacle is received and retained and a cap releasably mounted to the opening of the container and carrying the bud receivable into the receptacle in a slightly compressed condition so that when the bud is removed out of the receptacle by a rotary operation of the cap with respect to the container, a uniform coating of the cream is formed on the bud. The present invention also features a cavity defined in a top of the cap and is openably closed by a lid. The cavity serves as an additional storage space for cosmetics, which can be different from the cream contained in the container, so that multiple utilization of the cosmetic jar is obtained through the present invention.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification an drawings identical reference numeral refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
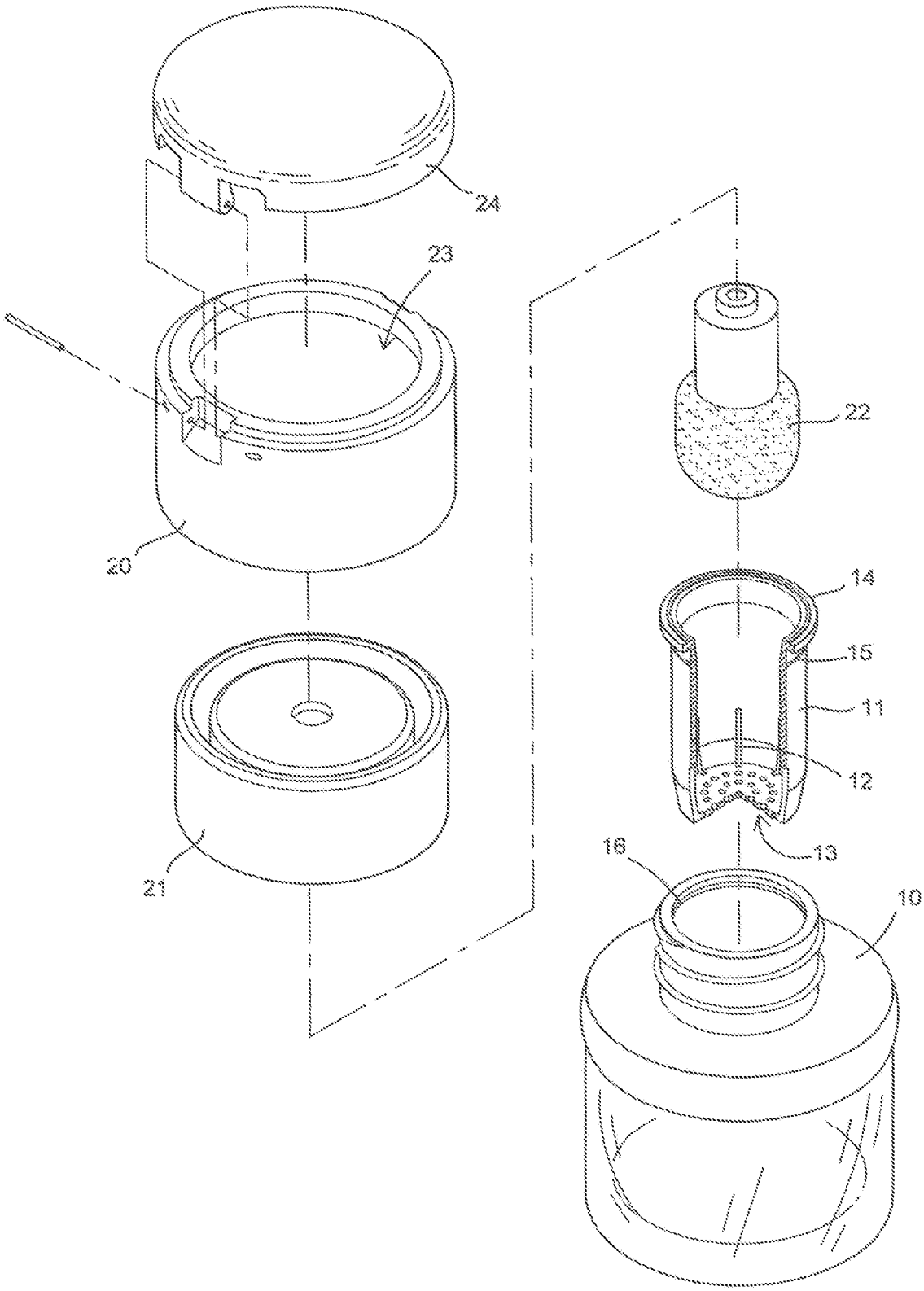
FIG. 1 is an exploded view of a cosmetic jar constructed in accordance with the present invention.
Figure 8:
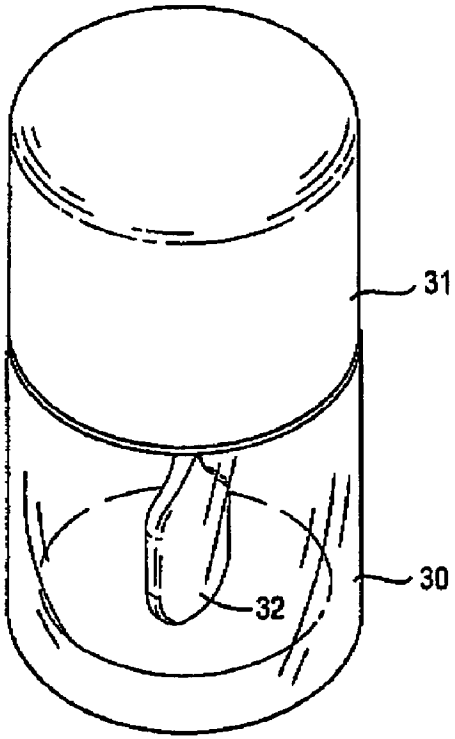
FIG. 8 PRIOR ART
FIG. 8 is a perspective view of the conventional cosmetic jar.
Figure 2:
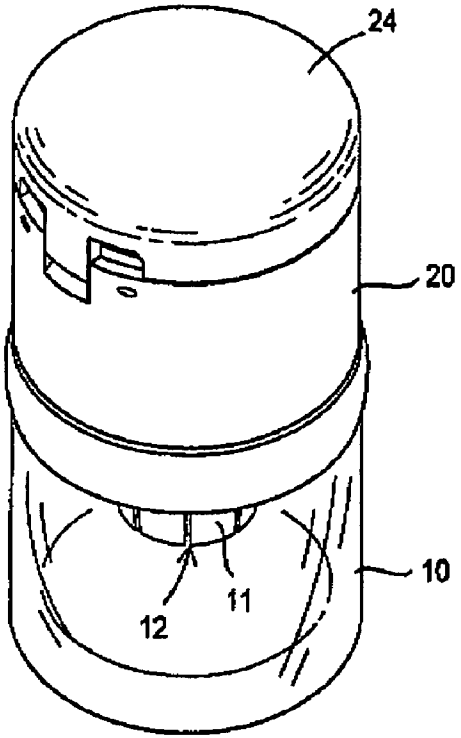
FIG. 2 is a perspective view of the cosmetic jar of the present invention in a lid closed condition.
Figure 4:
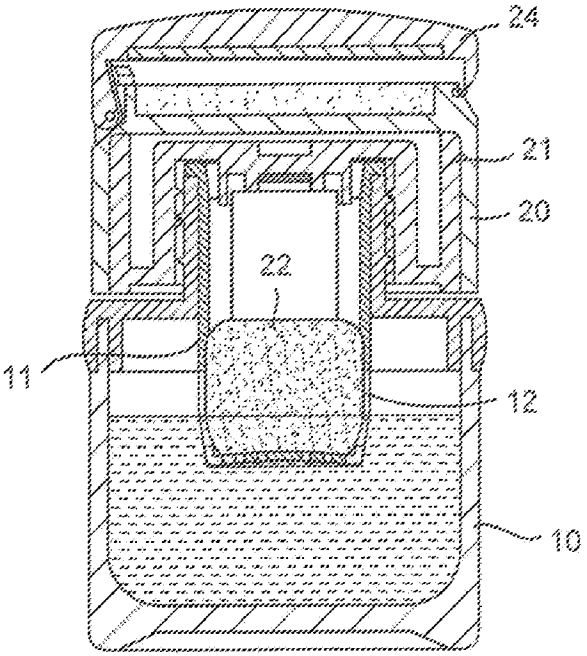
FIG. 4 is a cross-sectional view of the cosmetic jar of the present invention where a cap portion is secured to a container portion.
Figure 3:
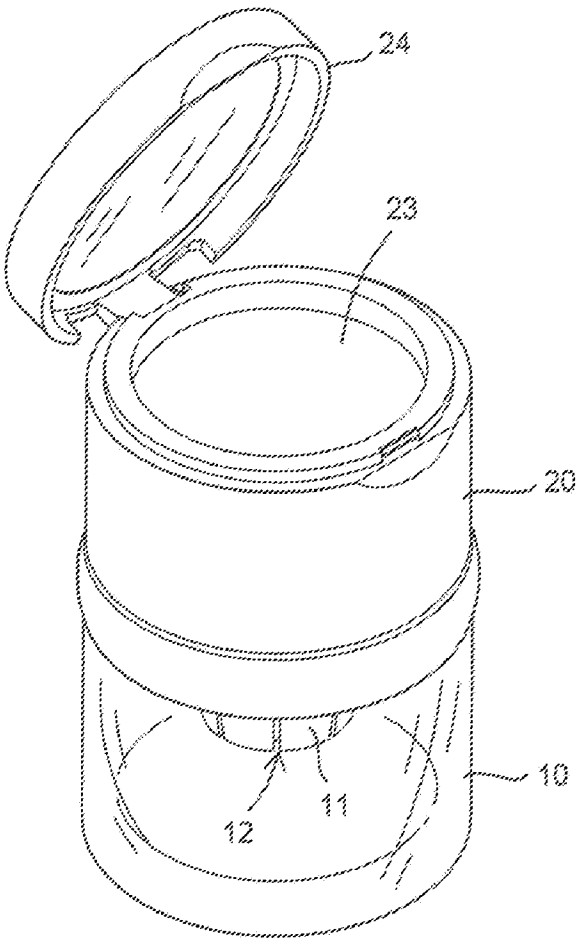
FIG. 3 is a perspective view of the cosmetic jar of the present invention in a lid opened condition.
Figure 6:
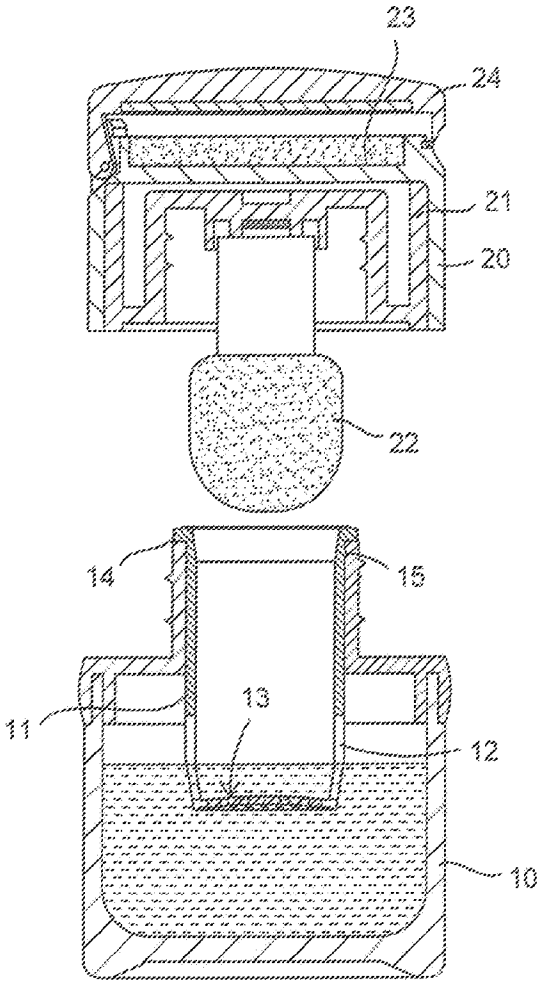
FIG. 6 is similar to FIGS. 4 and 5, but showing the cap portion is completely detached from the container portion.
Figure 5:
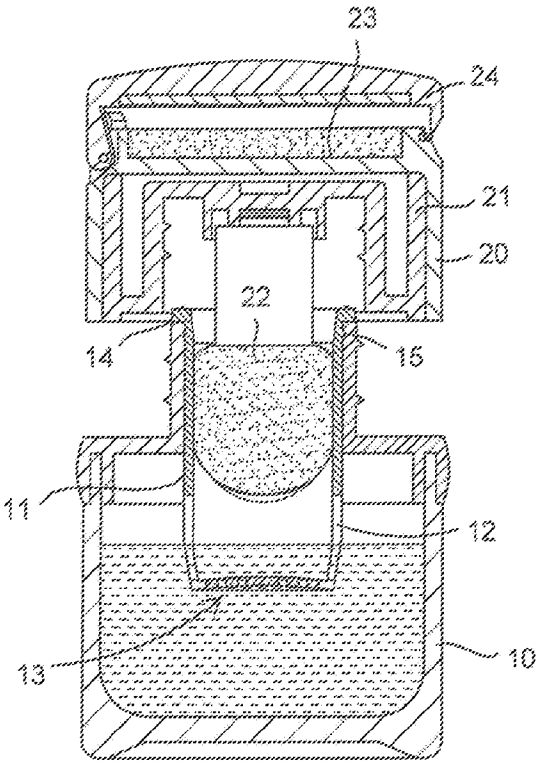
FIG. 5 is a similar to FIG. 4 but showing the cap portion is partially released from the container portion.
Figure 7:
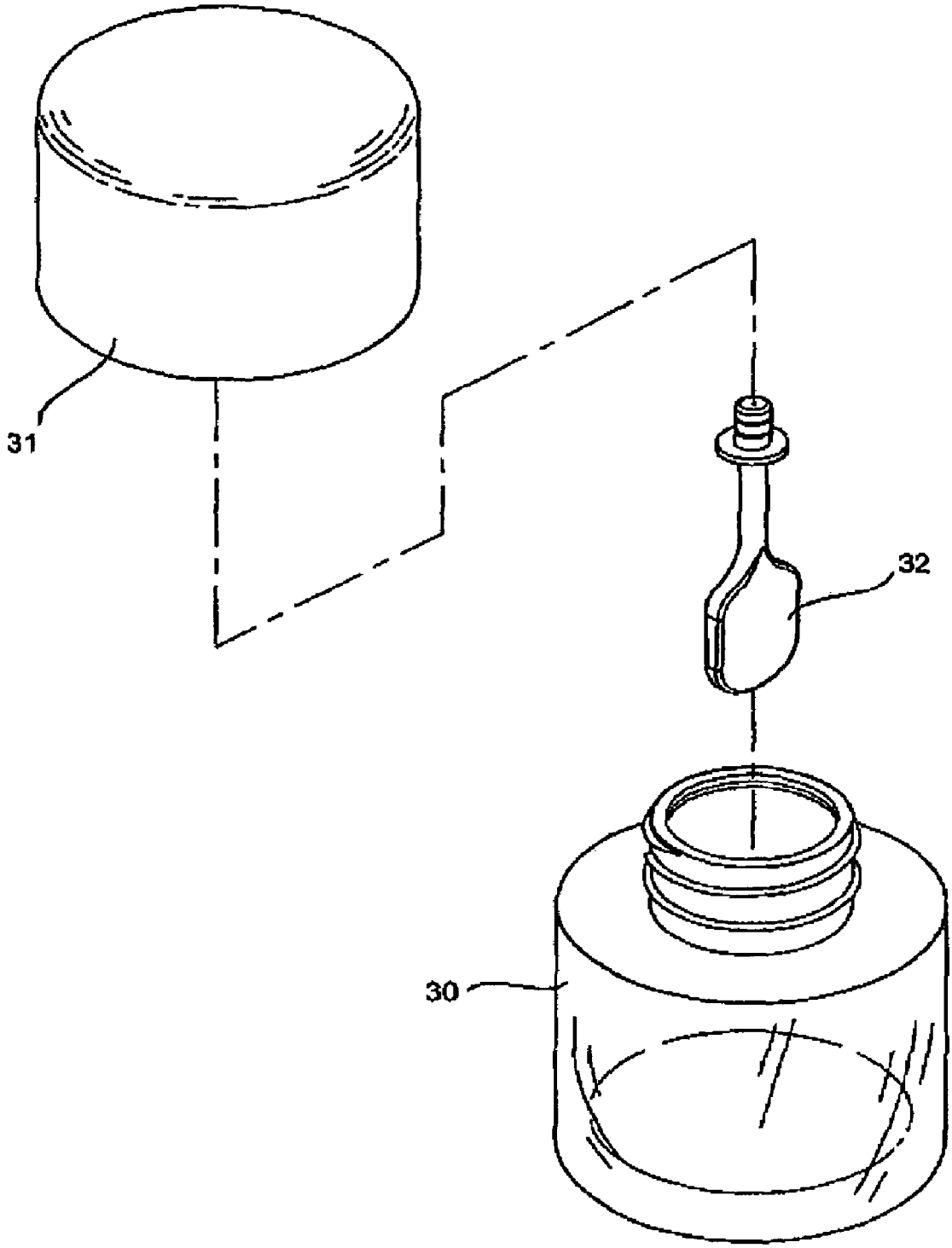
FIG . 7 PRIOR ART
FIG. 7 is an exploded view showing a conventional cosmetic jar.

With reference to drawings and in particular to FIGS. 1-6, a cosmetic cream jar in which the present invention is embodied is illustrated. The cosmetic cream jar comprises a container portion 10 and a cap portion 20, which are made separately. The cap portion 20 is releasably engageable with the container portion 10 to seal an opening of the container portion, preferably in threading engagement.

The container portion 10 comprises a hollow container or jar that forms the opening through which cosmetic cream or paste or ointment having high flowability is deposited into the container portion 10. An application receptacle 11, which has a U-shaped cross-section in the vertical direction in a normal use condition and thus having an open top and a closed bottom, is received in the container portion 10 and retained in the opening of the container portion 10. The receptacle 11 has a circumferential wall, which is substantially cylindrical in the embodiment illustrated and surrounding a vertical axis of the receptacle 11, and the closed bottom is formed at a lower edge of the circumferential wall. In the embodiment illustrated, the U-shaped cross-section of the receptacle 11 shows a converged lower portion structure having a truncated conic shape in cross-section. The circumferential wall of the receptacle 11 defines slits 12, which are spaced circumferentially and extend axially. Further, apertures 13 are defined in, and preferably uniformly distributed on, the bottom of the receptacle 11. Both the slits 12 and the apertures 13 allow the cosmetic cream or paste that is received in the container portion 10 to flow therethrough and into the receptacle 11 for subsequent application to for example a user's face.

To securely retain the receptacle 11 to the opening of the container portion 10, the receptacle 11, which can be made of injection-molding of plastics, forms a radially expanded flange 14, which is positionable on and supported by a top rim of the opening of the container portion 10 to retain the receptacle 11 in the opening of the container portion 10, and a circumferential rib 15 on an outer surface of the circumferential wall of the receptacle 11, which can snap into a corresponding circumferential groove 16 defined in an inside surface of the opening of the container portion 10 to thereby secure the receptacle 11 inside the container portion 10. The radially extended flange 14 of the receptacle 11 has a top rim serving to tightly engage the cap portion 20 and thus providing sealing against leakage of the cosmetic cream between the opening of the container portion 10 and the cap portion 20.

The cap portion 20 is comprised of a circumferential outer wall delimiting an interior space in which an inner cap 21 is securely fixed. The inner cap 21 is made of plastics and elastically deformable. The inner cap 21, which is threadedly engageable with the container portion 10, is configured in a manner that corresponds in size and shape to the opening of the container portion 10 so as to selectively effect tight engagement with the opening of the container portion 10. A central portion of the inner cap 21 is properly recessed/raised to reatin an absorptive application bud 22, which is of excellent capability of absorption of liquid and is also elastically deformable. The application bud 22 can be attached to the inner cap 21 by means of for example fitting, snapping or adhesives.

The application bud 22 has an overall dimension in the axial direction, which is referred to as "length" of the application bud 22 that substantially corresponds to a depth of the receptacle 11, which is measured in the axial direction substantially from the top opening to the closed bottom of the receptacle 11. Thus, when the cap portion 20 is secured to the container portion 10, the application bud 22 is snugly accommodated in the receptacle 11, and is preferably elastically deformed in either radial direction or axial direction or both. Preferably, the application bud 22 has a rounded lower portion, substantially corresponding to the conic configuration of the bottom of the receptacle 11 to prevent excessive compression of the application bud 22 and permanent deformation caused by the excessive compression. When the cap portion 20 is detached from the container portion 10, the application bud 22 automatically expands due to resiliency thereof and at the same time absorbs a portion of the cream. In the course of separating from the receptacle 11, due to the threading engagement between the cap portion 20 and the container portion 10, the application bud 22 rotates and sweeps over the inner surface of the circumferential wall of the receptacle 11 to have excessive cream scooped therefrom whereby a uniform coating of the cream can be formed on the application bud 22 for easy and immediate application. The application bud 22 can be made of any material that is in a puffed condition and is capable to absorb the cream and is elastically deformable. The puffed condition of the application bud 22 makes the contact feeling comfortable to ensure comfortable and easy application of the cream.

If desired, the cap portion 20, has a closed top which defines a cavity 23 in the top wall thereof for receiving and retaining other cosmetics, such as cream of low flowability or powders. A top lid 24 is further provided to openably close the cavity 23, preferably in a pivotal manner. This arrangement provides a user with convenience and efficiency for outside use of cosmetics. The application bud 22 is of a simple and easy-to-manufacture structure consisting of a soft surface, such as cotton, for comfortable contact with a user's skin and having a high absorbability of liquid (the cream deposited in the container portion) and being directly attached to the inner cap 21 with a proper length for snugly fitting into while at the same time being elastically compressed by the receptacle 11 to effect absorption of a proper amount of cream. The rotary movement of detaching the cap portion 20 from the container portion 10 allows gradually expansion of the bud 22 and sweeping along the circumferential wall of the receptacle 11 to prevent excessive amount of cream from being removed from the receptacle 11 by the bud 22. Another advantage of the present invention is the provision of the cavity 23 in the cap portion 20 for addition storage of different cosmetics.

Although the present invention has been described with reference to the preferred embodiment thereof, it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since is will be understood that various omissions, modifications, substitutions and changes in the forms and details of the device illustrated and in its operation can be made by those skilled in the art without departing in any way from the spirit of the present invention.

I claim:

1. An application device comprising:

a container portion having an opening through which cosmetic cream is deposited therein;

a receptacle having a U-shaped cross section and having an open top and a closed bottom, said receptacle being received in said container portion and retained in said opening of said container portion, said receptacle having a circumferential wall and being cylindrical in shape, said receptacle having a converged lower portion structure which has a conic shape in cross-section, said receptacle defining slits which are spaced circumferentially and extend axially, said bottom of said receptacle having a plurality of apertures, said slits and apertures allowing said cosmetic cream received in said container portion to flow therethrough and into said receptacle for application to a user's face, said receptacle having a top formed with a radially expanded flange which is supported by a top rim of said opening of said container portion, an outer surface of said circumferential wall of said receptacle being provided with a circumferential rib which is able to be snapped into a corresponding circumferential groove defined in an inside surface of said opening of said container portion thereby securing said receptacle inside said container portion;

a cap portion having a circumferential outer wall delimiting an interior space;

an inner cap securely fixed in said interior space of said cap portion, said cap portion having a top formed with a cavity for receiving and retaining cosmetic powder, said inner cap being threadably engageable with said container portion;

an absorptive application bud, said inner cap having a central portion recessed to retain said absorptive application bud, said absorptive application bud being elastically deformable and configured to be snugly accommodated in said receptacle when said inner cap is threadably engaged with said container portion, said absorptive application bud having a rounded lower portion for preventing excessive compression of said absorptive application bud when said absorptive application bud is snugly accommodated in said receptacle; and a top lid pivotally connected with said cap portion for openably close said cavity;

whereby when said cap portion is rotated to detach from said container portion, said absorptive application bud will gradually expand due to resiliency, absorb a portion of said cosmetic cream and sweep over an inner surface of a circumferential wall of said receptacle to have excessive cream scooped therefrom thereby providing a uniform coating of said cosmetic cream on said absorptive application bud.

2. The application device as claimed in claim 1, wherein said inner cap is made of plastics.

3. The application device as claimed in claim 1, wherein said absorptive application bud inner cap is attached to said inner cap by adhesive.

* * * * *